United States Patent [19]

Canals

[11] Patent Number: 4,586,586

[45] Date of Patent: May 6, 1986

[54] WORK-STEP FOR EXTENSION LADDER

[76] Inventor: Carlos Canals, 28 Nichols Ave., Brooklyn, N.Y. 11208

[21] Appl. No.: 765,129

[22] Filed: Aug. 13, 1985

[51] Int. Cl.[4] ..... E06C 1/12; E06C 1/387

[52] U.S. Cl. ..... 182/118; 182/122

[58] Field of Search ..... 182/120, 121, 122, 166, 182/167, 116, 91, 118

[56] References Cited

U.S. PATENT DOCUMENTS

| | | | |
|---|---|---|---|
| D. 155,566 | 10/1949 | Agricola | 182/121 |
| 248,014 | 10/1881 | Boardman | 182/120 |
| 794,729 | 7/1905 | McDonnall | 182/122 |
| 1,735,003 | 11/1929 | Heidel | 182/122 |
| 1,921,583 | 8/1933 | Reed | 182/121 |
| 1,953,390 | 4/1934 | Bosch | 182/121 |
| 2,148,958 | 2/1939 | Myers | 182/120 |
| 2,282,133 | 5/1942 | Horton | 182/121 |
| 2,415,289 | 2/1947 | Jury | 182/121 |
| 2,500,559 | 3/1950 | Miller | 182/121 |
| 3,115,214 | 12/1963 | Roberts | 182/120 |

*Primary Examiner*—Reinaldo P. Machado

*Attorney, Agent, or Firm*—Morgan, Finnegan et al.

[57] ABSTRACT

A novel work-step attachment for an extension ladder is described. The work-step attachment generally comprises a platform which is secured to a ladder segment having two vertical side frames in parallel relationship and at least one horizontal rung extending therebetween. The work-step attachment also comprises a hooking element adapted to engage a rung of an extension ladder, as well as a locking element to lock the platform in a first position in which it is aligned with the rung of the ladder segment and in a second position in which it is substantially aligned in the plane of the parallel side frames of the ladder segment.

6 Claims, 5 Drawing Figures

WORK-STEP FOR EXTENSION LADDER

BACKGROUND OF THE INVENTION

This invention is directed to a work-step attachment for an extension ladder and the combination so formed. More particularly, this invention is directed to a work-step which may be readily attached to a conventional extension ladder and collapsed and stored in situ on the ladder when the ladder is not in use.

The narrow rungs present on the extension part of conventional extension ladders are difficult to use for extended periods of time, such as when painting or cleaning, because, as one climbs onto the extension part of the ladder, his/her feet must balance on single narrow rungs of the extension ladder. In typical use, the full weight of the body is positioned on a single narrow rung, which causes strain and discomfort to the user's legs and feet, especially over extended periods of time. Moreover, during such typical use, the user has little or no flexibility of movement because of the difficulty of balancing on the small narrow surface provided by the rung.

Several attempts have been made to provide a wider foot support in the form of a work-step attachment for use with a ladder. These work step attachments, as exemplified by U.S. Des. Pat. No. 155,566 and U.S Pat. Nos. 2,415,289; 2,148,958; 1,735,003; 2,282,133; and 2,500,559, generally extend out of and away from the ladder. They also extend from the wall on which the ladder is to be rested. Because of this configuration, these work step attachments are difficult to use. They require the user to balance away from the ladder in order to mount the work-step. Moreover, these work step attachments are not foldable or collapsible and must be removed with each use.

U.S. Pat. No. 248,041 describes the combination of a work-step attachment and an extension ladder. This arrangement, however, presents the same drawbacks previously discussed in that it extends out of the ladder and away from the wall on which the ladder is to be rested and, thus, is also difficult to mount. In addition, this work step must also be removed after each use.

It is therefore an object of the present invention to provide an improved work-step attachment for an extension ladder which does not extend away from the wall on which the ladder is to be rested, thus providing greater stability and balance to a user stepping onto the work-step.

Another object of the present invention is to provide an improved work-step attachment for an extension ladder, such as a metal extension ladder, which step does not slip or slide when in use.

Yet another object of the present invention is to provide a detachable work-step attachment for an extension ladder which, when not in use, may be conveniently collapsed allowing the ladder to be easily stored with the work-step mounted thereon.

Another object of the present invention is to provide an improved work-step attachment for an extension ladder which remains mounted on said extension ladder allowing the ladder to be used without having to disengage the work-step attachment when the attachment is not needed.

SUMMARY OF THE INVENTION

Briefly described, the present invention is a work-step attachment which is adapted for use with an extension ladder.

For the purposes of this discussion, the elements of the work step attachment will be described from the point of reference of an observer looking upon a work-step that is mounted on an extension ladder which is placed in a substantially vertical position in use. The extension part of the extension ladder is the front of the ladder while the stationary section of the ladder is the back.

The work-step attachment generally comprises a platform which is articulately secured to a ladder segment. The ladder segment has at least one horizontal rung. Preferably, the ladder segment has two horizontal rungs in parallel relationship with each other. The rung(s) extends between and is connected at right angles to first and second vertical side frames of the ladder segment. The platform rests partially on the rung and is essentially in axial alignment therewith. The platform generally comprises a rectangularly shaped, planar base upon which a user's feet may be placed when the ladder is in use. One side portion of the platform rests on the rung when the platform is in a first position. The balance of the platform extends away from the ladder segment and at substantially a right angle with the side frames when the platform is in said first position. The work step attachment further comprises hooking means fixedly secured to at least one of the side frames. The hooking means comprises a hook having a slightly convex, cam-like upper surface and terminating in a finger like projection. The hooking means has rotatably secured to it a latch which cooperates with the hook to secure the work-step attachment to an extension ladder. The ladder segment of the invention further comprises locking means fixedly secured to at least one of the vertical side frames of said ladder segment and engageably connected to said platform. The locking means is capable of locking said platform in a first position when it is coaligned with the rung on which it rests as when the platform is in use, and in a second position when it is substantially coaligned with the side frames as when the platform is not in use.

The present invention, by providing a flat wide surface which extends toward the wall against which the ladder is rested, enables the user to stand more naturally and, thus, balance better than when standing on a conventional ladder rung. In addition, in contrast to prior work-steps, the present invention does not require the user to balance away from the ladder in order to mount the platform.

Other features and advantages inherent in this invention will become apparent from an examination of the accompanying Drawings wherein like numbers are used to designate like-parts.

BRIEF DESCRIPTION OF THE DRAWINGS

Referring to FIGS. 1, 2 and 3, there are shown three views of a preferred embodiment of this invention. In FIG. 1, the work-step segment is shown individually with the platform horizontal as it would be during use. FIG. 2 shows a segment of a ladder with the work step segment mounted thereon with the platform in a vertical position as it would be when not in use or when being stored. FIG. 3 shows the work-step segment mounted on an extension ladder with the platform in a horizontal position ready for use.

Figure 1:
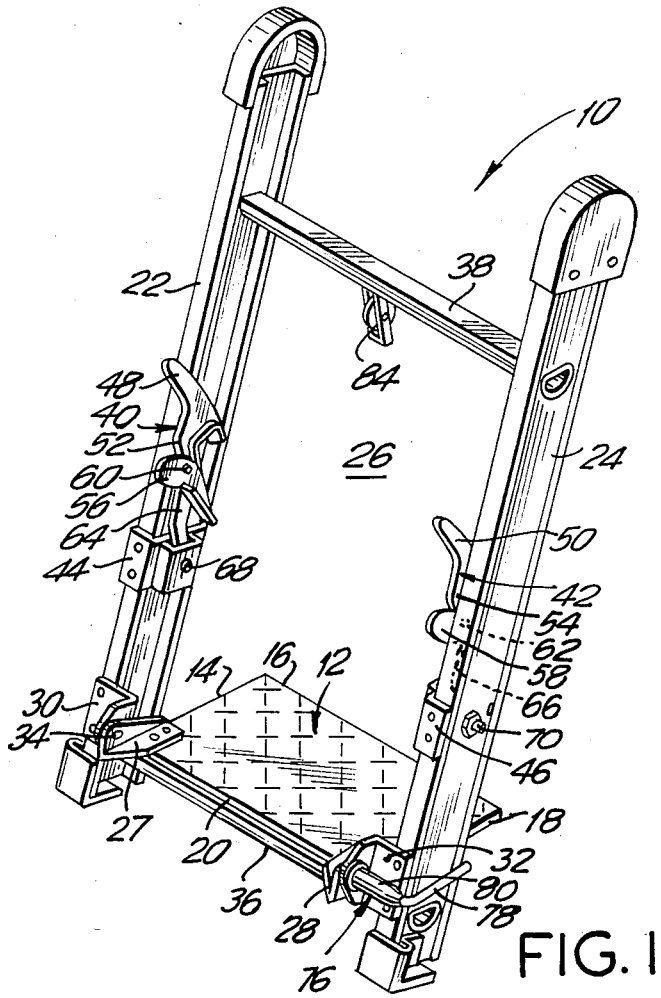
FIG. 1 is a perspective view of the work-step segment with the platform in operating position.

Shown in the Figures is a work-step attachment, generally designated 10, which comprises in part platform 12. Platform 12 is shown as a rectangularly shaped, planar substrate having sidewalls 14, 16, 18 and 20. The platform is preferably made of metal but may be made of any other suitable material. Sidewalls 14 and 18 of platform 12 are affixed to side frames 22 and 24 of a ladder segment, which is generally designated 26. Side frames 22 and 24 are affixed to sidewalls 14 and 18, respectively, of platform 12 by metal angles 27 and 28 which are rotatably affixed to brackets 30 and 32 by bolts 34 and 35. At a position above brackets 30 and 32, and between rungs 36 and 38 of ladder segment 26, are hooking elements 40 and 42, which are affixed to side frames 22 and 24 by brackets 44 and 46. Hooking elements 40 and 42 serve to hook onto and maintain the work step in position on an extension ladder. The structure and function of hooking elements 40 and 42 will be familiar to those skilled in the art as they are commonly found on existing extension ladders. Similar to hooking elements known in the art, hooking elements 40 and 42 generally comprise hooks 48 and 50, which terminate in finger-like projections 52 and 54. Finger-like projections 52 and 54 are rotatably connected to latches 56 and 58 by bolts 60 and 62 as shown in the figures. Latches 56 and 58 are, in turn, also rotatably connected to arms 64 and 66. Arms 64 and 66 are then fixedly attached to brackets 44 and 46 by bolts 68 and 70.

Figure 2:
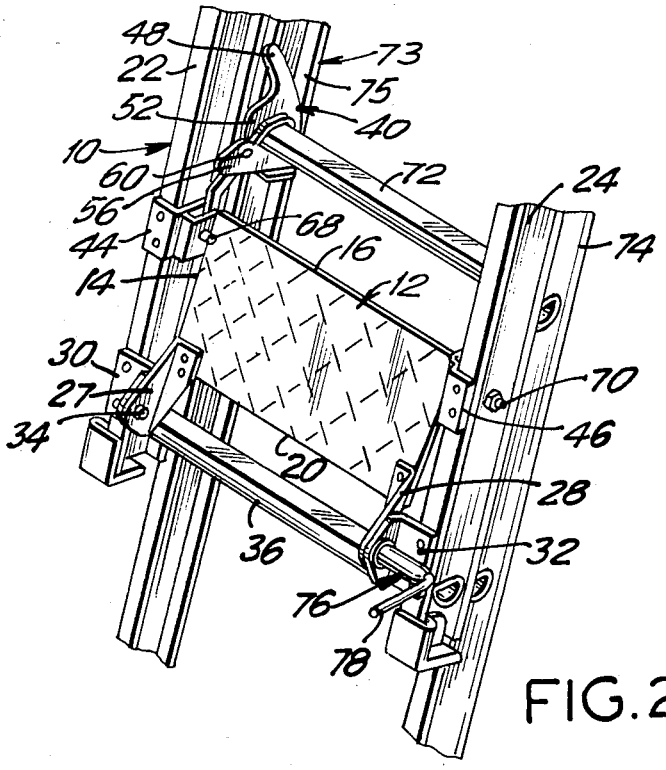
FIG. 2 is a perspective view of the work step segment mounted on an extension ladder with the platform locked in a position where it is substantially coaligned with the side frames.
Figure 3:
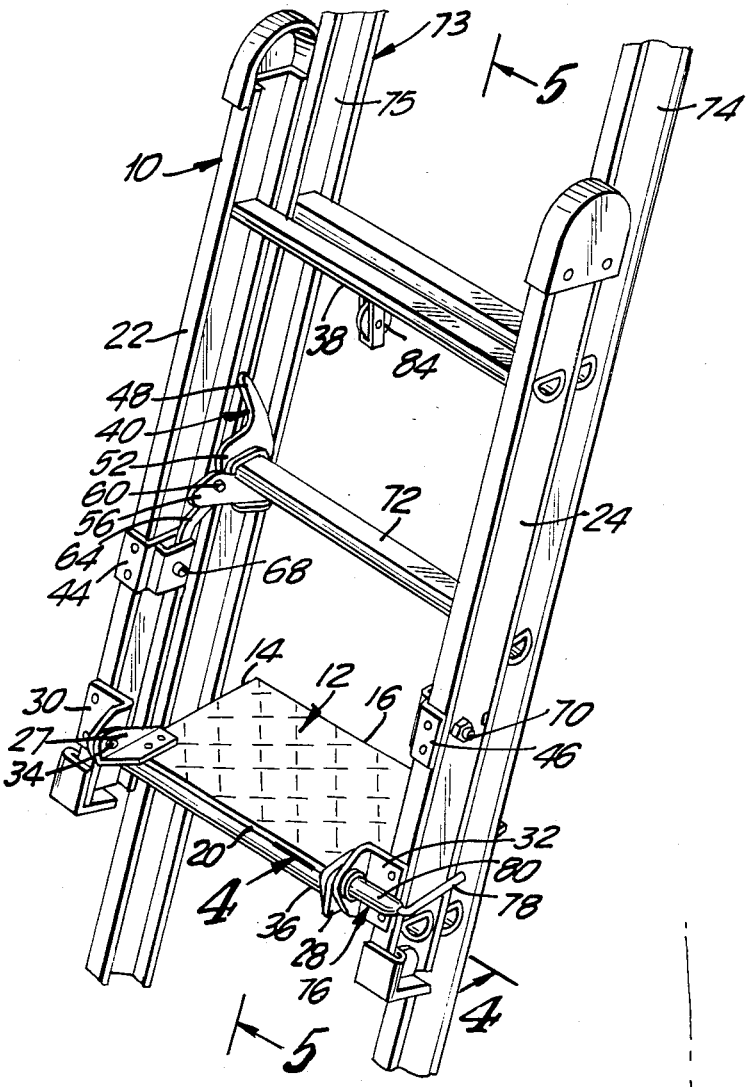
FIG. 3 is perspective view of the work-step segment mounted on an extension ladder with the platform in a position where it is coaligned with the rung on which it rests when the platform is in use.
Figure 5:
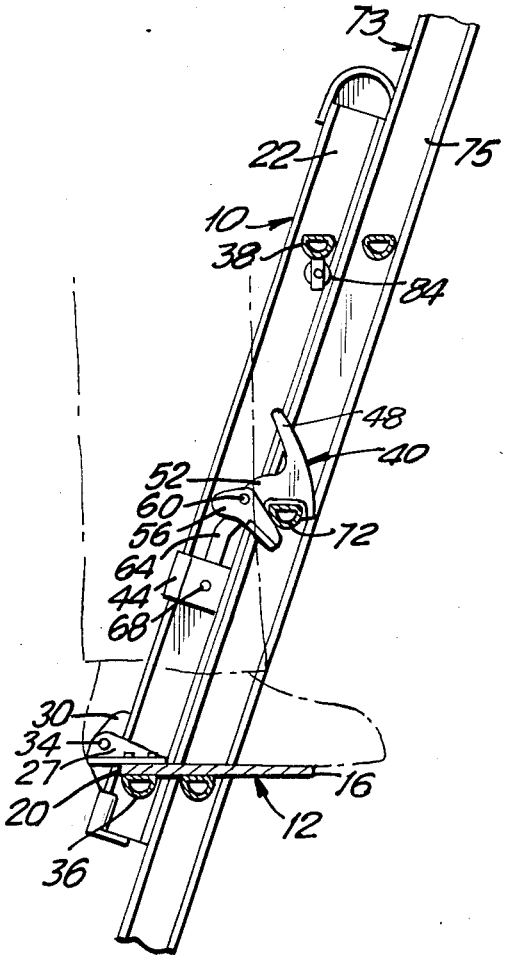
FIG. 5 is a transverse view along line 5—5 of FIG. 3.

The above described hooking elements operate as exemplified in FIGS. 2, 3 and 5. In use, hooks 48 and 50 are slid over and hooked onto rung 72 of entension ladder 73. When hooks 48 and 50 are hooked onto rung 72, this causes latches 56 and 58 to rotate about bolts 60 and 62, as is shown in the figures, and thereby lock hooks 48 and 50 in position over rung 72. In use, hooks 48 and 50 will only disengage when the user applies pressure to the work-step attachment along the longitudinal axis of the extension ladder. Application of such pressure causes rung 72 to push down on latches 56 and 58 causing them to rotate in a direction opposite to the pressure and thereby force hooks 48 and 50 to rotate in the same direction that pressure is applied and disengage from rung 72.

Figure 4:
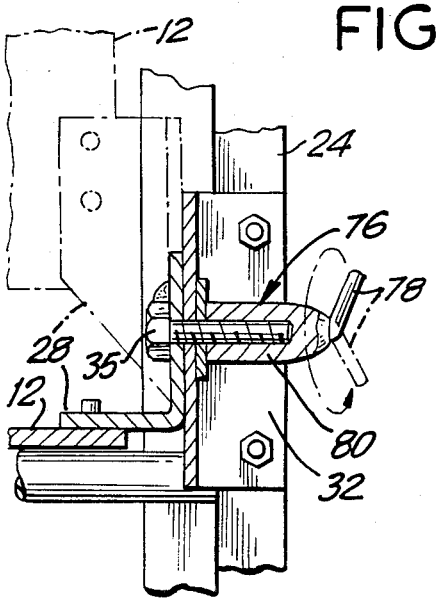
FIG. 4 is an exploded transverse section along line 4—4 of FIG. 3 showing the locking mechanism.

Affixed to sidewall 18 of platform 12 is locking element 76. Locking element 76 comprises lock handle 78, which is rotatably connected to sleeve 80 (FIG. 4). Sleeve 80 is internally threaded to receive bolt 35 which, in turn, is externally threaded so as to engage the inner surface of sleeve 80 in a mating relationship. As is shown in FIGS. 3 and 4, bolt 35 affixes locking means 76 to bracket 32 and metal angle 28. When handle 78 is turned, it rotates sleeve 80 and draws bolt 35 within sleeve 80 until there is friction between bracket 32 and metal angle 28. Bolt 35 thus serves to lock platform 12 either in a first position, in which it is coaligned with rung 36 on which it rests or, in a second position, in which it is coaligned with side frames 22 and 24.

When not in use, as depicted in FIG. 2, platform 12 may be rotated about bolts 34 and 35 so that it is positioned vertically between rungs 36 and 38 of ladder segment 26 and rests upon bolts 68 and 70 of brackets 44 and 46.

When the work-step is in use, as depicted by FIGS. 3 and 5, platform 12 is in a horizontal position extending towards the wall against which the ladder is to be rested so that a person using the work-step does not have to push back and away from the ladder in order to step onto the platform. Platform 12 is safely maintained in a horizontal position as respects the ground by adjusting locking element 76 so as to allow the platform to rest partly on rung 35, the lowest rung of the work-step ladder segment, and then frictionally locking the platform in this position as described above.

The work-step of the present invention may have, optionally, one or two locking elements. A second locking element can be disposed on bracket 30.

In the preferred embodiment shown in FIG. 3, work-step attachment 10 is designed so that it may be used with conventional aluminum extension ladders. Thus, vertical side frames 22 and 24 of the work step segment may be designed so as to slidably engage side frames 74 and 75 of an aluminum extension ladder in a conventional manner as is used to engage the slidable portion of the extension ladder onto the fixed ladder portion of the ladder. Platform 12 may thus be conveniently folded out of the way when not in use without necessitating removal of the work-segment.

In a preferred embodiment of the invention, the platform is corrugated to provide extra protection against the user slipping. In addition, ladder segment 26 may comprise pulley 84 through which a rope may be threaded so as to enable the user to move the work-step attachment along the extension ladder by conventional means.

As seen from the foregoing drawings and description, the present invention presents many advantages over the prior art. The present invention allows the user to comfortably stand while working on the ladder without unduly straining the feet or legs. The work-step attachment of the present invention provides a balanced workspace which extends away from the body of the user and towards the wall on which the ladder is rested thus posing no difficulty in mounting. In addition, the work-step segment is easy to use with conventional extension ladders and may be conveniently collapsed when not in use permitting the extension ladder to be used or stored without necessitating removal of the work-step. Thus, the work-step may remain permanently on the extension ladder and may be used only when needed without the added complications of removal and storage each time. In addition, locking element 76 provides an added degree of security and safety for the worker using the work-step.

What is claimed is:

1. A work-step attachment adapted for use with an extension ladder, comprising a platform which is articulately secured to a ladder segment having first and second vertical side frames in parallel relationship to each other and at least one horizontal rung extending therebetween and being connected at right angles to the vertical side frames, said rung being located beneath said platform and essentially in axial alignment therewith, the ladder segment further comprising hooking means fixedly secured to at least one of the vertical side frames, said hooking means being adapted to engage a run of an extension ladder, said ladder segment further comprising locking means fixedly secured to at least one of the vertical side frames of said ladder segment and engageably connected to said platform, said locking means being capable of locking said platform in a first position in which it is in axial alignment with said rung, and in a second position in which it is substantially aligned in the plane of said parallel side frames, said work step attachment also including means for engaging an extension ladder to enable said work step attachment to be located along the length of said extension ladder.

2. The work-step attachment of claim 1 comprising hooking means secured to each of said side frames.

3. The work-step attachment of claim 1 wherein said hooking means comprises a hook and cooperating latch.

4. The work-step attachment of claim 1 comprising locking means secured to each of said side frames.

5. The work-step attachment of claim 1 wherein said locking means comprises a lock handle rotably connected to a sleeve, said sleeve being internally threaded to receive a bolt, said bolt being externally threaded so as to engage the inner surface of the sleeve in a mating relationship, said bolt serving to affix said locking means to one of the vertical side frames of said work step attachment so that when the lock handle is rotated the sleeve is caused to draw the bolt within it thereby frictionally engaging the platform to the vertical side frame.

6. The work-step attachment of claim 1 in combination with an extension ladder.

* * * * *